United States Patent [19]

Truran

[11] 4,280,475

[45] Jul. 28, 1981

[54] SCREEN FOR FIREPLACE GRATE

[76] Inventor: Peter W. Truran, 6092 Meyers, Brighton, Mich. 48116

[21] Appl. No.: 111,490

[22] Filed: Jan. 14, 1980

[51] Int. Cl.[3] ..... F23H 13/00

[52] U.S. Cl. ..... 126/164; 126/152 B

[58] Field of Search ..... 126/120, 121, 152 R, 126/152 B, 164, 165, 298, 163 A, 163 R, 242–245

[56] References Cited

U.S. PATENT DOCUMENTS

| | | | |
|---|---|---|---|
| 890,669 | 6/1908 | Low | 126/298 |
| 3,536,057 | 10/1970 | Grosso | 126/165 |
| 4,078,542 | 3/1978 | Young et al. | 126/164 |
| 4,122,825 | 10/1978 | Slate | 126/164 |

FOREIGN PATENT DOCUMENTS

| | | | |
|---|---|---|---|
| 179620 | 5/1922 | United Kingdom | 126/164 |

*Primary Examiner*—James C. Yeung

*Attorney, Agent, or Firm*—Cullen, Sloman, Cantor, Grauer, Scott & Rutherford

[57] ABSTRACT

A screen to be attached to and suspended below a fireplace grate. The grate supports logs to be burned in the fireplace and as the logs burn, hot coals fall through the grate and are supported on the screen. The screen is sufficiently close to the grate such that the hot coals on the screen aid in igniting subsequent logs placed on the fireplace grate, and aid in the complete burning of partially burned logs on the grate.

5 Claims, 6 Drawing Figures

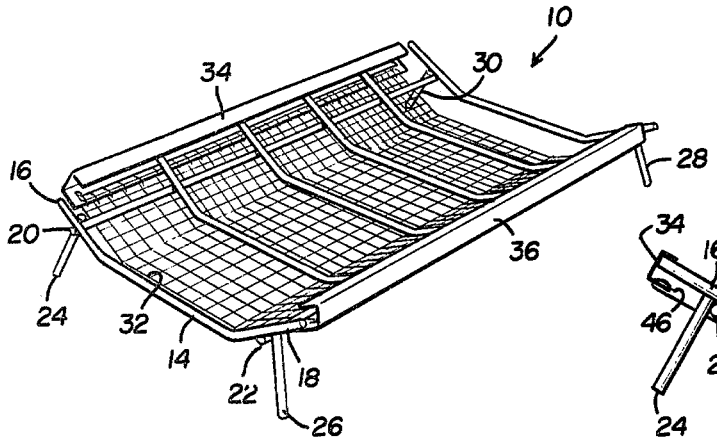
FIG. 1
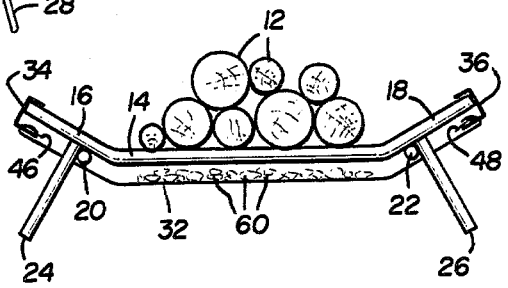
FIG. 2
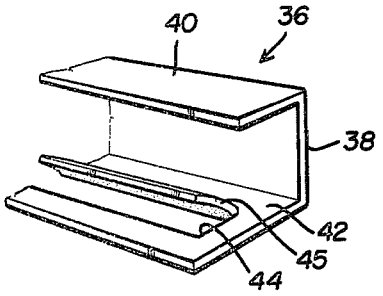
FIG. 3
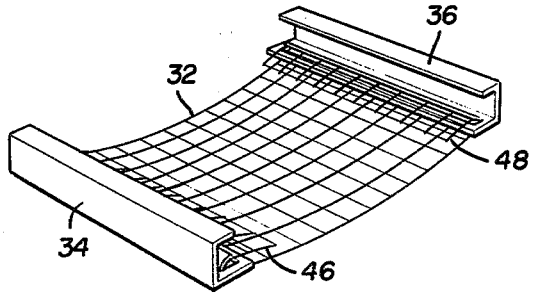
FIG. 4
FIG. 5
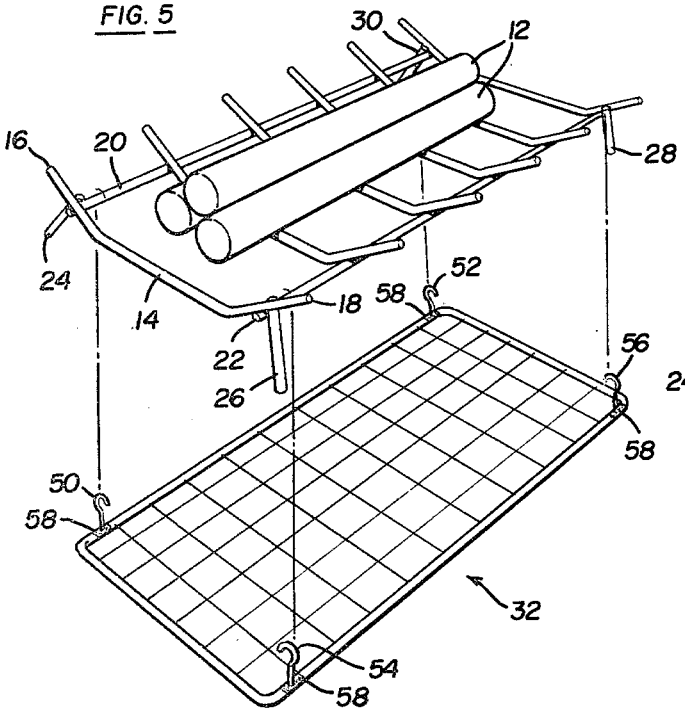
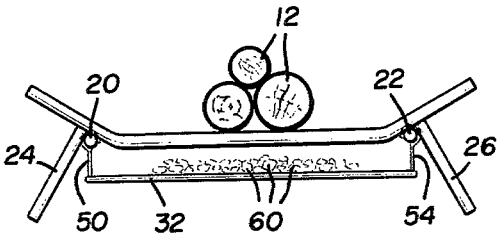
FIG. 6

SCREEN FOR FIREPLACE GRATE

BACKGROUND OF THE INVENTION

This invention relates generally to fireplace grates and, more particularly, to an improved fireplace grate combination including a screen suspended below the fireplace grate.

The use of a grate in a fireplace to support logs which are to be burned is, of course, quite well-known. Typically such fireplace grates comprise a substantially open metal framework to support the logs to be burned and, as the logs burn, the hot coals fall to the bottom of the fireplace. New logs are placed on the fireplace grate if it is desired to keep the fire in the fireplace burning.

Prior to the present invention there have been many attempts to aid in collecting the ash which forms when the logs burn and, in addition, there are various configurations of fireplace grates. These may be found, for example, in U.S. Pat. No. Des. 247,343, U.S. Pat. Nos. 78,685; 267,499; 709,377; 927,214; 1,385,931; 2,585,523; 3,439,667, and 3,536,057 as well as British Patent No. 1,646 of 1913. Prior to the present invention, however, the prior art has not recognized the problems of aiding in completely burning logs on the fireplace grate, or of aiding in igniting subsequent logs placed on the fireplace grate nor the potential solution of spacing the hot coals from the burning logs a slight distance below the logs to assist in igniting and burning unburned and partially burned logs.

Thus the present invention overcomes the shortcomings of the prior art by providing an improved fireplace grate and screen whereby the hot coals from burning logs are utilized to assist in burning partially burned logs and in igniting additional logs as such additional logs are placed on the grate.

SUMMARY OF THE INVENTION

The present invention is directed to an improved fireplace grate in combination with a screen attached to the grate and suspended below the grate to receive hot coals from logs burning on the fireplace grate. When new logs are placed on the grate, the hot coals aid in igniting the new logs and hence the screen is suspended from the grate a sufficiently small distance so that the hot coals are in close proximity to the grate itself. The present invention further provides for complete burning of logs to maximize efficiency of a fireplace and reduce the waste of logs being only partially burned. Thus as hot coals fall on the screen they aid in maintaining a sufficiently high temperature at the grate so that any partially burned logs will burn completely.

The present invention further contemplates a screen which is removably attached to the grate and suspended therefrom which screen may be of square or hexagonal mesh. Thus wire screens commonly called hardware cloth may be utilized.

BRIEF DESCRIPTION OF THE DRAWINGS

The various objects and benefits of the present invention, together with other benefits which may be attained by its use, will become more apparent upon reading the following detailed description of the invention taken in conjunction with the drawings.

In the drawings, wherein like reference numerals identify corresponding parts:

FIG. 1 is a perspective illustration of the fireplace grate and screen of the present invention;

FIG. 2 is a side elevation view of the fireplace grate and screen of the present invention;

FIG. 3 is a perspective illustration of a channel used to secure the screen to the grate;

FIG. 4 is a perspective illustration of the screen attached to a pair of opposed channels;

FIG. 5 is an exploded perspective illustration of an alternate embodiment of the present invention; and FIG. 6 is a side elevation view of the fireplace grate and screen of FIG. 5.

DETAILED DESCRIPTION OF THE INVENTION

With reference to FIGS. 1 and 2 of the drawings a fireplace grate 10 is disclosed upon which a series of logs 12 are placed for burning. The grate 10 may be of conventional metal construction including a series of spaced apart U-shaped log supporting members each having an elongated base 14 and opposed relatively short arms 16 and 18. As is conventional with fireplace grates, the U-shaped members open upwardly and outwardly with the arms 16 and 18 being at an obtuse angle from the base 14.

The fireplace grate typically includes a plurality of longitudinal metal support bars 20, 22 extending transversely of the U-shaped members with bar 20 suitably welded beneath and to each of the arms 16 and 22 extending beneath and suitably welded to each of the arms 18 of the U-shaped members.

The fireplace grate 10 further includes a plurality of metal feet 24, 26, 28 and 30 each welded to and extending downwardly from the grate 10. As illustrated, feet 24 and 26 are welded to the bar 20 at opposite ends thereof while feet 28 and 30 are welded to the bar 22 at opposite ends thereof. The entire grate is conventionally made of suitable metal to withstand the heat of the fire and the feet 24, 26, 28 and 30 are of sufficient length to maintain and support the grate a sufficient first distance above the floor of a fireplace such that air to fuel the fire can readily flow first under the logs 12 and then upwardly between individual logs. The logs 12 are disposed generally transversely of the bases 14 of the U-shaped members of the grate.

As is well-known, as the logs 12 burn within a fireplace, hot coals drop through the spaces between the U-shaped members and fall to the floor of the fireplace. The hot coals will continue to burn somewhat, but are not always completely reduced to ash. After cooling, the remaining coals are removed and discarded. As the logs 12 burn and are consumed, new logs are typically placed on the fireplace grate 10.

Prior to the present invention, it has been found that the weight of new logs 12 placed upon the fireplace tend to push the hot coals and remaining portions of partially burned logs through the spaces between the U-shaped grate members and to the floor of the fireplace. Thus the logs do not burn completely and, furthermore, the hot coals do not assist materially in igniting subsequent logs. Prior to the present invention, to overcome this problem, new logs were typically placed on top of existing burning logs before such burning logs were sufficiently small to be forced between the U-shaped members of the grate and this, of course, typically resulted in a physically large build up of logs on top of the grate. The result, of course, is well-known in that the new logs, as they ignite, often roll off of the remaining portions of the previously ignited logs and, in fact, often fall off of the grate because of the relative height of the pile of logs.

The present invention overcomes these problems by the provision of a screen 32 attached to and suspended from the fireplace grate. The screen 32 may be of square or hexagonal mesh wire, commonly called hardware cloth, and is preferably one-half inch square mesh.

In accordance with a preferred embodiment of the present invention means are provided to removably attach the screen 32 to the grate 10. As illustrated in FIGS. 2, 3 and 4, a pair of metal channels 34, 36 are provided. Each such channel is C-shaped having a base 38 and spaced-apart parallel upper and lower legs 40, 42, respectively. Each lower leg 42 is provided with an elongated slot 44 which extends substantially the full length of the channel. Preferably the slot is provided by forming a louver 45 as part of the leg 42.

The height of the channel base 38, which defines the distance between the channel legs is such that the channels may be force-fit or snap-fit onto the ends of the arms 16, 18 of the log supporting members and be frictionally retained thereon. The slots are provided so that the screen 32 may be secured to the channels 34, 36.

Specifically, the screen 32 is inserted through a slot 44 in a first channel 34 and extends through the slot and is then folded back upon itself as at 46. Thus one end of the screen is secured to the channel 34 and the other end of the screen is free. Then the channel 34 is force-fit over the ends of the arms 16, thus securing the channel, and one end of the screen, to the grate. Next the free end of the screen is extended underneath the grate 10, in close proximity to the bases 14 of the log supporting members.

Continuing with an explanation of the assembly of the screen to the grate, the free end of the screen is inserted through the slot 44 in the second channel 36 and the second channel is force-fit onto the ends of the arms 18. The free end of the screen is pulled taut so that the screen is about one inch below the bases 14 of the log supporting members. Then the free end of the screen is folded back on itself, as at 48 to maintain the screen in position beneath the grate.

This completes the explanation of a preferred embodiment of the present invention. The channels 34 and 36 may, of course, be removed from the grate 10 when desired such as for cleaning the screen. As assembled to the grate, the channels extend parallel to the logs 12.

Referring to FIGS. 5 and 6, an alternate embodiment of the invention is disclosed for removably securing the screen 32 to the grate 10. Specifically, the screen is suspended from the grate by a plurality of hooks 50, 52, 54, 56. Each hook is adapted to fit over a bar 20, 22 and each hook is welded, as at 58, to the screen 32, preferably adjacent a corner of the screen.

In each of the two embodiments of the present invention the screen is suspended from the grate and positioned a second distance below the grate intermediate the bases 14 of the U-shaped log supporting members and the floor of the fireplace. The distance between the bases 14 of the U-shaped log supporting members and the screen 32 is less than the length of each of the feet 24, 26, 28 and 30, thus providing substantial room beneath the screen 32 for air to flow and thus fuel the fire.

The proximity of the screen 32 to the grate is such that hot coals 60 falling through the spaces between the grate members and retained on the screen are sufficiently close to the grate to assist in igniting unburned logs placed on the grate. Furthermore, the distance between the screen 32 and the floor of the fireplace is sufficient such that air can readily flow underneath the screen and through the screen upwardly toward the logs to assist in completely burning the hot coals 60. Also, the proximity of the coals to the grate provides additional heat so that partially burned logs 12 will burn completely. Finally, the distance from the bottom of the screen 32 to the floor is sufficiently high to allow a build up of ash without blocking the flow of air upwardly through the screen.

The foregoing is a complete description of the present invention. Various changes and modifications may, of course, be made without departing from the spirit and scope of the present invention. The invention, therefore, should be limited only by the following claims.

What is claimed is:

1. In combination with a fireplace grate of the type for supporting logs to be burned a first distance above the floor of a fireplace, said grate including a plurality of spaced apart log support members, each log support member having first and second ends, the improvement comprising a screen, and means for attaching said screen to said grate a second distance below said grate, said second distance being less than said first distance, so that when logs are burned on said grate, the hot coals which result from burning said logs fall from said grate and rest on and are supported by said screen; said second distance being sufficiently small so that hot coals aid in completely burning logs on the grate and aid in igniting unburned logs placed on said grate; and said first distance exceeds said second distance by a sufficient amount so that air can flow upwardly through said screen to maintain said hot coals burning; said screen attaching means including a pair of opposed spaced apart C-shaped channels, each of said channels including an upstanding base and spaced apart parallel upper and lower legs, said lower leg being provided with an elongated slot which extends substantially the full length of the channel to receive said screen, the first channel of said pair of channels being frictionally retained on the first ends of said plurality of log support members and the second channel of said pair of channels being frictionally retained on the second ends of said plurality of log support members.

2. The invention as defined in claim 1 wherein said screen attaching means is for removably attaching said screen to said fireplace grate.

3. The invention as defined in claim 1 wherein said screen is of square mesh.

4. The invention as defined in claim 1 wherein said screen is of square one-half inch mesh.

5. The invention as defined in claim 1 wherein said channel members extend parallel to the logs on said grate.

* * * * *